US005526804A

United States Patent [19]

Ottestad

[11] Patent Number: 5,526,804

[45] Date of Patent: Jun. 18, 1996

[54] SELF-SUFFICIENT EMERGENCY BREATHING DEVICE

[75] Inventor: Nils T. Ottestad, Tønsberg, Norway

[73] Assignee: Ottestad Breathing Systems AS, Norway

[21] Appl. No.: 199,182

[22] PCT Filed: Aug. 26, 1992

[86] PCT No.: PCT/NO92/00134

§ 371 Date: Jun. 13, 1994

§ 102(e) Date: Jun. 13, 1994

[87] PCT Pub. No.: WO93/03794

PCT Pub. Date: Mar. 4, 1993

[30] Foreign Application Priority Data

Aug. 27, 1991 [NO] Norway ..... 913352

[51] Int. Cl.[6] ..... A62B 7/02

[52] U.S. Cl. ..... 128/201.25; 128/201.28; 128/201.22; 128/204.26; 128/205.25; 128/205.28

[58] Field of Search ..... 128/201.25, 201.28, 128/201.22, 204.26, 205.25, 205.11, 205.28, 201.23

[56] References Cited

U.S. PATENT DOCUMENTS

| | | | |
|---|---|---|---|
| 2,048,059 | 7/1936 | De Boudemange | 128/201.25 |
| 3,481,333 | 12/1969 | Garrison | 128/201.28 |
| 3,491,752 | 1/1970 | Cowley | 128/147 |
| 3,565,068 | 2/1971 | Bickford | 128/142 |
| 3,935,861 | 2/1976 | Warmcle | 129/142 R |
| 3,976,063 | 8/1976 | Henneman et al. | 128/201.25 |
| 4,057,058 | 11/1977 | Kovocevic | 128/201.23 |
| 4,233,970 | 11/1980 | Kranz | 128/201.28 |
| 4,331,141 | 5/1982 | Pokhis | 128/201.25 |
| 4,378,011 | 3/1983 | Warncke et al. | 128/201.28 |
| 4,411,023 | 10/1983 | Pinson | 128/201.26 |
| 4,440,163 | 4/1984 | Spergel | 128/205.13 |
| 4,508,115 | 4/1985 | Warncke | 128/201.28 |
| 4,552,140 | 11/1985 | Cowley et al. | 128/201.2 |
| 4,608,976 | 9/1986 | Suchy | 128/201.28 |
| 4,614,186 | 9/1986 | John | 128/201.26 |
| 4,889,113 | 12/1989 | Pelloux-Gervais et al. | 128/201.25 |
| 4,896,665 | 1/1990 | Gervais | 128/201.25 |
| 4,938,211 | 7/1990 | Takahashi | 128/205.28 |
| 4,998,529 | 3/1991 | Werjefelt | 128/205.28 |
| 5,027,810 | 7/1991 | Patureau et al. | 128/201.22 |
| 5,036,841 | 8/1991 | Hamilton | 128/205.28 |
| 5,113,854 | 5/1992 | Dosch et al. | 128/201.23 |
| 5,133,344 | 7/1992 | Jurrius et al. | 128/201.23 |

FOREIGN PATENT DOCUMENTS

| | | | |
|---|---|---|---|
| 2651917 | 5/1978 | Germany | 128/201.24 |
| 5352 | 11/1896 | Norway . | |
| 90/00421 | 1/1990 | WIPO . | |
| 91/00120 | 1/1991 | WIPO . | |
| 9419055 | 9/1994 | WIPO | 128/201.24 |

*Primary Examiner*—Edgar S. Burr
*Assistant Examiner*—William J. Deane, Jr.
*Attorney, Agent, or Firm*—Dressler, Goldsmith, Shore & Milnamow, Ltd.

[57] ABSTRACT

An emergency breathing device for use of evacuation in connection with fires, chemical accidents or the like, and which comprises a heat-resisting and gas-tight protective hood (1) which is adapted to surround the head (2) of a user, and wherein there are arranged an oxygen supply unit having a reservoir (12) for the supply of oxygen to the breathing air in the hood, and a $CO_2$ absorber (14) for purifying the breathing air. The hood (1) has double walls (3, 4) for providing a closed breathing bag (5) which is separated from the surrounding atmosphere and which is provided with a suitable positioned mouthpiece (7) for use by the user. Further, the oxygen supply unit comprises a dosing means (40) which is arranged to inject oxygen in accordance with the breathing frequency of the user.

7 Claims, 3 Drawing Sheets

SELF-SUFFICIENT EMERGENCY BREATHING DEVICE

TECHNICAL FIELD OF THE INVENTION

The invention relates to an emergency breathing device, comprising a gas-tight protective hood adapted to surround the head of a user and in which there are arranged an oxygen supply unit having a reservoir for the supply of oxygen to the breathing air in the hood, and a $CO_2$ absorber for purifying the breathing air.

BACKGROUND OF THE INVENTION

There has previously been developed a number of different types of breathing equipment for respiration protection during stays for a shorter or longer time in a contaminated atmosphere. Most of this equipment has been developed for professional effort in the fighting of fires or the like. One achieves an efficient protection, but the size, weight, price, etc. make the equipment unsuitable as a general "escape equipment". An escape equipment should be able to find room in a little bag, be operative at short notice, and give an efficient respiration protection for approximately 10 minutes. In spite of the fact that the need for such an equipment undoubtedly is great, there is—as far as one knows—no commercially available equipment which satisfies these requirements.

From U.S. Pat. No. 4,552,140 there is known a transparent impervious flexible hood for placing over the head of a user and which is sealingly affixed to an inflatable collar. An annular saddle-shaped reservoir contains a supply of pressurized oxygen gas and is concentrically positioned on the collar, so that when this is inflated the weight of the reservoir seals the collar around the neck of the user. A control mechanism is actuatable by the user for the supply of oxygen gas for simultaneously filling the hood and inflating the collar. In the hood there is also arranged a $CO_2$ absorber for purifying exhaled gas, and an ejector means is provided for guiding the breathing gas through the absorber so that the gas may be recirculated.

SUMMARY OF THE INVENTION

The object of the invention is to provide an emergency breathing device which satisfies the requirements stated in the introduction, and more specifically a self-sufficient, functionally safe and simultaneously simple and reasonable device which, for a given time period, is able to maintain the supply of breathing gas to a user in case of escape and during short stays in a contaminated and oxygen-pure atmosphere.

The above-mentioned object is achieved with an emergency breathing device of the introductorily stated type which, according to the invention, is characterized in that the hood has double walls for providing a closed breathing bag which is separated from the surrounding atmosphere and which is provided with a suitably positioned mouthpiece for use by the user, and that the oxygen supply unit comprises an oxygen dosing means arranged to be actuated in accordance with the breathing pattern of the user.

In the device according to the invention, a complete closed breathing system is built into a specially developed protective hood which advantageously is made of a heat-resistant and gas-tight material. The device in practice may be made operative in a few seconds by breaking a plastic seal, whereafter the hood is unfolded and the oxygen dosing means is activated. Thereafter the hood is pulled over the user's head, and a lace means is tightened for sealing at the neck and the back of the head of the user.

The fact that the hood has double walls for the provision of a closed breathing bag which is separated from the surrounding atmosphere, implies that the hood can be put on directly also in a contaminated atmosphere and immediately ensures the supply of fresh breathing gas to the user when the mouthpiece is in place in the mouth. The dosing means of the device also represents an important security aspect, the means injecting oxygen in accordance with the breathing frequency of the user and ensuring supply of breathable air irrespective of how hard the user is breathing.

The device according to the invention has been developed with a view to achieving a low weight and an ergonomically favorable design. In an advantageous embodiment the oxygen reservoir is constituted essentially by the cavity of a closed high-pressure tube forming an annular collar around the lower part of the hood. This tube for example may be made of acid-resisting steel with an outer diameter of 20 mm and a ring diameter of 250 mm, and then will be able to contain an oxygen quantity which is sufficient for approximately 10 minutes use.

The invention will be further described below in connection with an exemplary embodiment with reference to the accompanying drawings.

DETAILED DESCRIPTION OF ILLUSTRATED EMBODIMENT

Figure 1:
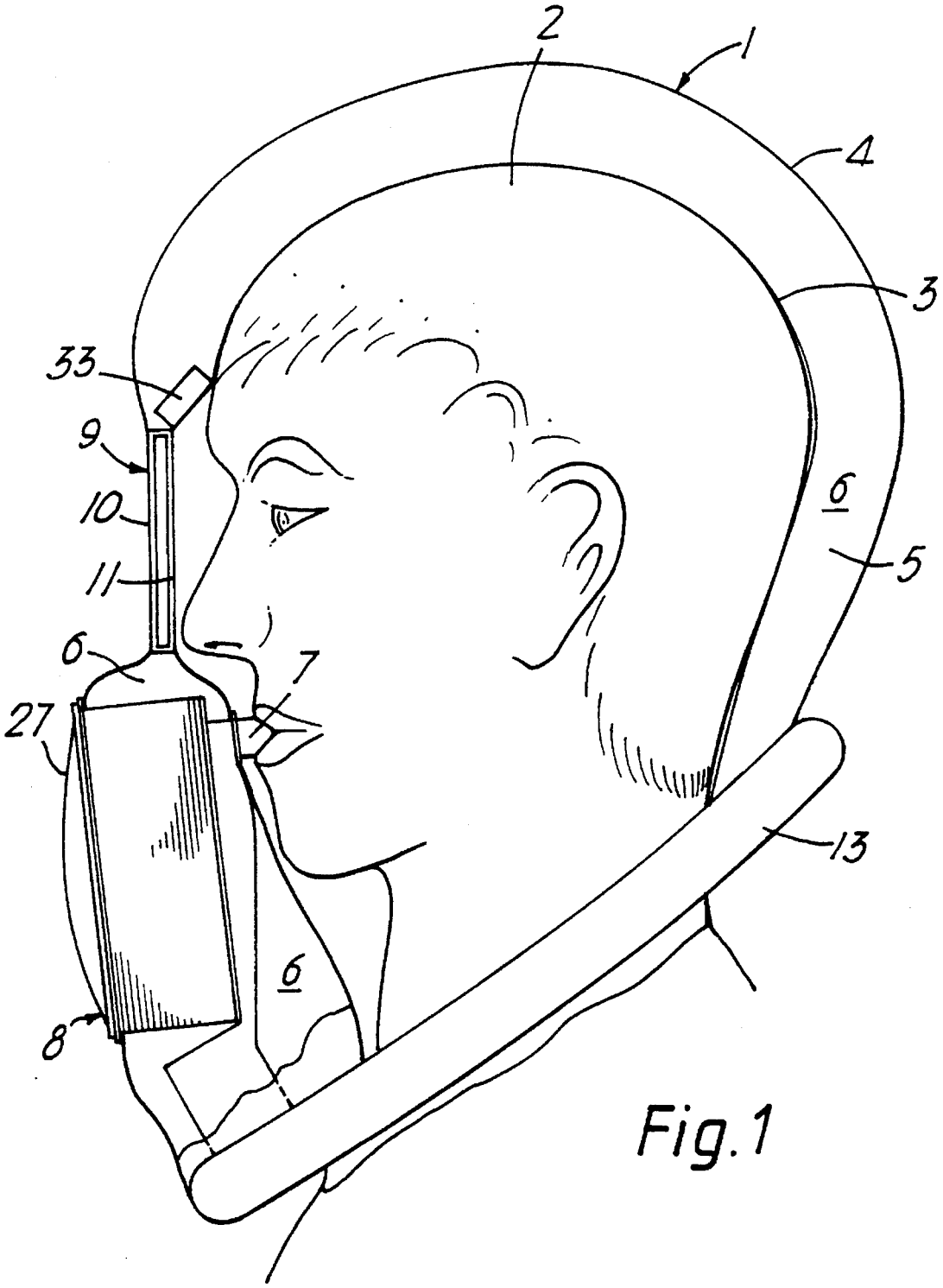
FIG. 1 shows a side view of a device according to the invention placed over the head of a user.

As shown in FIG. 1, the illustrated device comprises a protective hood 1 which is placed over the head 2 of a user, and which advantageously is made of a pliant, gas-tight and heat-resistant and possibly also transparent material. The hood has double walls 3, 4 for providing a closed breathing bag 5 which is separated from the surrounding atmosphere. The breathing bag 5 forms a continuous inner space or chamber, and the different continuous regions of the chamber in the drawings is designated 6. The breathing bag is provided with a suitably placed mouthpiece 7 for use by the user. The mouthpiece is connected to the breathing system part 8 of the device which will be described with references to FIGS. 2 and 3.

Further, the hood is provided with a visual field 9. Advantageously, this consists of double plastic plates 10 and 11 which, at the inside, are treated with a dew-reducing agent, to avoid problems with the visibility because of misting at the inside of the hood 1.

The oxygen supply unit of the hood comprises an oxygen reservoir which, in the illustrated embodiment, consists of a closed high-pressure tube 12 forming part of an annular collar 13 around the lower part of the hood. As mentioned before, this tube may be made of acid-resisting steel and be dimensioned as stated before.

Figure 2:
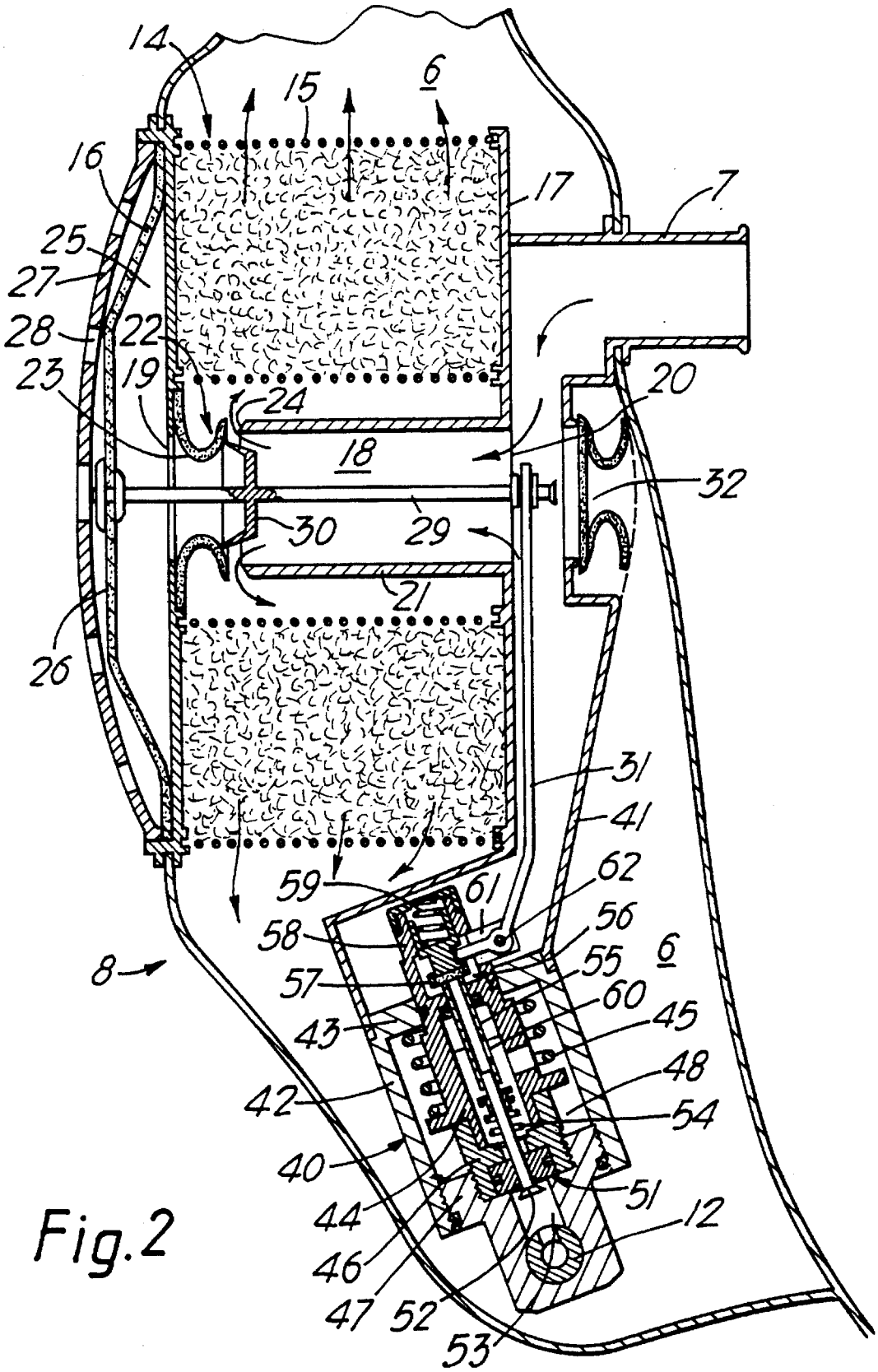
FIG. 2 shows a sectional side view of an embodiment of the breathing system part of the device during exhalation.
Figure 3:
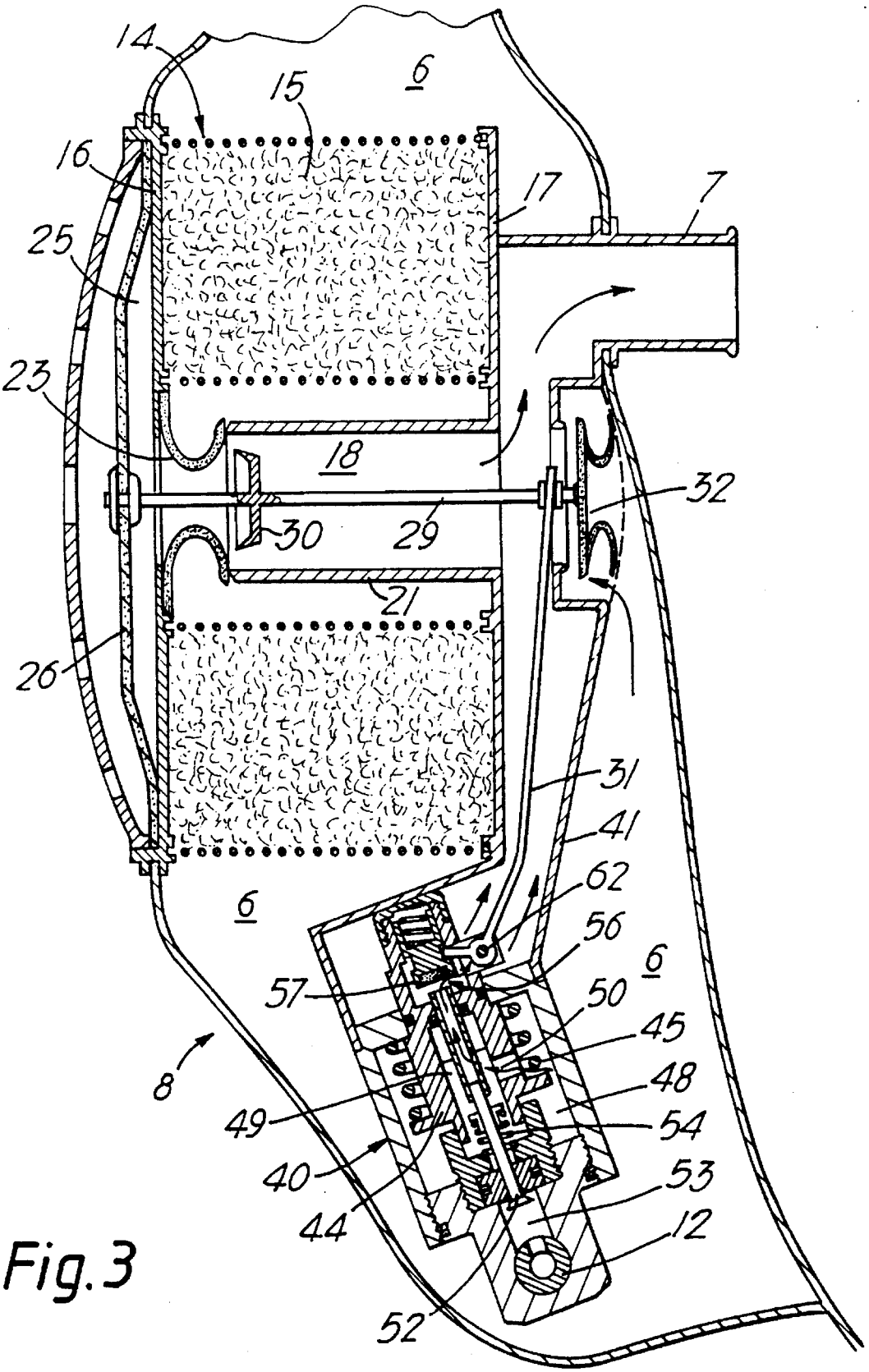
FIG. 3 shows a corresponding side view of the same embodiment during inhalation.

As appears from FIGS. 2 and 3, the breathing system part 8 is constructed in association with a $CO_2$ absorber or scrubber 14 for purification of the breathing air in the hood. The absorber comprises an absorbing body 15 arranged between a pair of end plates 16, 17 and which has a central through-going opening, so that a central passage 18 is formed through the absorber body 15 via central apertures 19, 20 in the end plates 16 17. The mouthpiece 7 communicates with the central passage 18 via the aperture 20 in the adjacent end plate 17. The passage 18 is partly defined by a channel member 21 which is connected to and extends inwardly of said aperture, and at the inner end of which a valve 22 is provided. The valve consists of a centrally open, flexible valve body 23 which with one end is connected to the aperture 19 in the end plate 16, and with its other end cooperates with a seat 24 formed on the adjacent end edge of the channel member 21.

The central passage 18 communicates via the aperture 19 with a chamber 25 which is defined by the end plate 16 and a pressure-sensing diaphragm 26. As shown, the sensing diaphragm 26 is clamped at its periphery, and on the outside it is covered by a protective cover 27 which is provided with a plurality of holes 28, so that the diaphragm on its outside communicates with the surrounding atmosphere. In its central area the diaphragm 26 is connected to one end of an operating rod 29 extending through the passage 18 and which, in connection with the valve 22, is provided with an operating member 30 for operating the valve body 23 when the sensing diaphragm 26 is influenced and moves with occurring pressure variations during the breathing cycle of the user, as further described below.

At its free end the operating rod 29 is connected to a lever 31 which is operatively coupled to the oxygen dosing means of the device, as further described below. Further, the free end of the rod 29 is arranged to operate a valve 32 which, when opened, forms an open connection between the mouthpiece 7 and the inner space 6 of the breathing bag 5, as appears from FIG. 3.

The oxygen dosing means 40 of the device is arranged to supply metered doses of oxygen to the mouthpiece 7 via a channel 41, when the user inhales. In the illustrated embodiment, the means comprises a cylindrical housing 42 having an end wall 43 facing the channel 41 and wherein a hollow piston 44 is slidably mounted. The piston is, by means of a spring 45, biased against a seat on a tubular support member 46 at the other end wall 47 of the housing. Between the inner walls of the housing 42 and the piston 44 there is formed a dosing chamber 48 communicating with the inner cavity 49 of the piston through a side opening 50 in the piston.

In the end wall 47 of the housing there is provided a first valve 51 having a rod-shaped valve body 52 for controlling the connection between the dosing chamber 48 and a high-pressure chamber 53 communicating with the high-pressure reservoir 12. The valve body 52 is biased towards the closed position of the valve by means of a spring 54. Further, the valve body 52 is fixedly connected to one end of a tube 55 which in a sealing manner is slidably mounted in a wall portion of the piston 44, so that tube extends outside of the inner cavity 49 of the piston. The other or outer end of the tube 55 forms a seat in a second valve 56 having a piston-shaped valve body 57 which is slidable in a guide in the outer end portion 58 of the piston 44, as shown in FIGS. 2 and 3. The valve body 57 is biased towards the closed position of the valve by means of a spring 59. When the valve 56 is opened, the dosing chamber 48 is connected to the channel 41 through a side opening 60 in the tube 55 and through an opening 61 in the outer end portion 58 of the piston 44.

As appears from FIGS. 2 and 3, the lever 31 is pivotally connected to the outer end portion of the piston 44 by means of a pivot 62, and it has a short arm which is in engagement with the valve body 57 to close and open the valve 56 in dependence on the movement of the lever under the influence of the sensing diaphragm 26.

The operation of the device will be further described below.

The direction of flow of the breathing gas is shown with arrows in FIGS. 2 and 3, FIG. 2 showing the situation with exhalation and FIG. 3 showing the situation with inhalation.

As shown in FIG. 2, exhaled gas passes through the mouthpiece 7, through the channel member 21 and through the central opening of the one-way valve 22 into the chamber 25. The sensing diaphragm 26 and the operating rod 29 are pressed to the left, and the valve operating member 30 brings the one-way valve 22 in open position, so that the exhaled gas is directed through the $CO_2$, absorber 14 and further into the breathing bag space 6. As the sensing diaphragm is pressed to the left, the operating rod 29 also brings with it the lever 31 which presses the spring-loaded valve body 57, and therewith also the tube 55 and the valve body 52, downwards, so that the valve 51 is opened for the supply of oxygen from the high-pressure chamber 53 to the inner cavity 49 of the piston 44 and the dosing chamber 48. The pressure in the dosing chamber rises quickly, and as the pressure is sufficient to neutralized the tension force of the spring 45, the piston 44 is pressed upwards in the housing 42. When the piston is moved upwards, the downwards directed pressure of the lever 31 on the spring-loaded valve body 57 is removed, and the tension of the spring 54 sees to it that the valve body 52 immediately closes the valve 51 and therewith shuts off the supply of oxygen to the dosing chamber 48. At the same time the spring 59 sees to it that the valve body 57 keeps the valve 56 closed.

As the inhalation starts, a negative pressure arises in the chamber 25, and the diaphragm 26 and the operating rod 29 are moved to the right. This implies that the short arm of the lever 31 presses the valve body 57 upwards, so that the valve 56 is opened and sets free the oxygen which was stored in the dosing chamber 48 in the previous exhalation, so that the metered oxygen dose is directed t the user via the channel 41 and the mouthpiece 7. Simultaneously, the operating rod 29 causes the valve 32 to be opened, so that an open connection from the breathing bag space 6 to the mouthpiece 7 is opened.

On condition that the device is correctly adjusted, it will not be possible to inhale or exhale without the dosing means beginning to function. This is ensured in that the dosing mechanism and the valves 22 and 32 are controlled by the same sensing diaphragm 26. By allowing the sensing diaphragm to be relatively large, a stable oxygen injection is combined with a low breathing resistance.

The quantity of oxygen injected with each inhalation is constant, and is calculated so that it is always larger than the quantity which is consumed. This implies that the oxygen level in the breathing air progressively will increase. Excessive air in the circulation during the exhalation is pressed out through the pressure relief valve 33 shown in FIG. 1, and further outwards through the neck seal. This solution contributes to protecting the user's face efficiently against the ingress of contaminated gas from the surrounding atmosphere, also for persons having a beard.

The hood of the device is pliant until the chamber 6 is completely filled with air. The total volume is approximately 3 liters. The use of a mouthpiece instead of an oral-nasal mask within the hood additionally eliminates the risk for ingress of contaminated gas, and the system is designed with a view to minimizing the risk for inhalation of contaminated gas in that the negative pressure arising with the inhalation is to be as small as possible. For this reason the $CO_2$ absorber is mounted at the exhalation side. Further, the air channels are coarsely dimensioned with a view to minimizing the breathing resistance and therewith ensure that the user is able to cope with hard physical strain.

I claim:

1. An emergency breathing device comprising a gas-tight protective hood which is arranged to surround the head of a user, an oxygen supply unit arranged in the hood and having an oxygen reservoir for the supply of oxygen to breathing air in the hood, a $CO_2$ absorber arranged in the hood, for purifying exhaled air, and a mouthpiece for insertion into the mouth of a user, the hood having an inner wall and an outer wall forming a closed volume between the inner and outer walls, the inner wall having an opening which is sealingly connected to the mouthpiece, the inner and outer walls thereby forming therebetween a closed breathing bag which is separated from the surrounding atmosphere, the oxygen supply unit and the $CO_2$ absorber being disposed in said breathing bag, the oxygen supply unit communicating with said mouthpiece and comprising an oxygen dosing means which is arranged to be actuated in response to the breathing pattern of a user, so that metered doses of oxygen are supplied to the breathing air inhaled by a user through the mouthpiece.

2. A device according to claim 1, wherein the oxygen supply unit comprises an annular collar around the lower part of the hood, the annular collar including a closed high-pressure tube having a cavity defining the oxygen reservoir.

3. An emergency breathing device comprising a gas-tight protective hood which is arranged to surround the head of a user, an oxygen supply unit arranged in the hood and having an oxygen reservoir for the supply of oxygen to breathing air in the hood, a $CO_2$ absorber arranged in the hood, for purifying exhaled air, and a mouthpiece for insertion into the mouth of a user, the hood having an inner wall and an outer wall forming a closed volume, the inner wall of the hood having an opening which is sealingly connected to the mouthpiece, so that a double-walled breathing bag is formed which is separated from the surrounding atmosphere, the oxygen supply unit comprising an oxygen dosing means which is arranged to be actuated in response to the breathing pattern of a user, and which communicates with said mouthpiece so that the air inhaled by a user has a sufficiently high oxygen level, wherein the dosing means comprises a first valve and a second valve and a dosing chamber communicating with the oxygen reservoir via the first valve and with the mouthpiece via the second valve, which valves are mechanically coupled to a sensing diaphragm which is influenced by occurring pressure variations during the breathing cycle of a user, so that the dosing chamber is filled with a metered oxygen quantity from the reservoir during exhalation, and so that the metered oxygen quantity is supplied from the dosing chamber to the breathing mouthpiece in the succeeding inhalation.

4. A device according to claim 3, wherein the device comprises a mechanical coupling between the sensing diaphragm and said valves, wherein each of the valves has a valve body, and wherein the mechanical coupling comprises a lever arranged to actuate the valve body of a respective one of the valves in dependence in the movement of the sensing diaphragm.

5. A device according to claim 4, wherein the mechanical coupling comprises an operating rod which is coupled to said lever, wherein additional valves are mechanically coupled to the sensing diaphragm, and wherein the sensing diaphragm has a central area, in which the sensing diaphragm is coupled to the operating rod, and wherein the operating rod is arranged to open one of the additional valves for the discharge of exhalation air from the mouthpiece to the breathing bag space, and thereafter to open another of the additional valves for the supply of inhalation air from the breathing bag to the mouthpiece.

6. A device according to any of claims 3, 4, or 5, wherein the dosing chamber is defined by a housing and a spring-loaded piston arranged in the housing, which piston is displaced when the pressure in the dosing chamber exceeds a given value, and thereby provides for closing of the first valve between the oxygen reservoir and the dosing chamber.

7. A device according to any of claims 3, 4, or 5, wherein the oxygen supply unit comprises an annular collar around the lower part of the hood, the annular collar including a closed high-pressure tube having a cavity defining the oxygen reservoir.

* * * * *